United States Patent [19]

Baltz et al.

[11] 4,375,206

[45] Mar. 1, 1983

[54] FUEL PRIMER AND ENRICHMENT SYSTEM FOR AN INTERNAL COMBUSTION ENGINE

[75] Inventors: Gene F. Baltz, Lake Villa; Paul W. Breckenfeld, Winthrop Harbor, both of Ill.

[73] Assignee: Outboard Marine Corporation, Waukegan, Ill.

[21] Appl. No.: 134,696

[22] Filed: Mar. 27, 1980

[51] Int. Cl.[3] ..... F02M 1/16; F02N 17/00

[52] U.S. Cl. ..... 123/187.5 R; 123/514

[58] Field of Search ..... 123/187.5 R, 179 L, 123/179 G, 180 R, 73 R, 73 A, 73 C, 514, 459

[56] References Cited

U.S. PATENT DOCUMENTS

| | | | |
|---|---|---|---|
| 1,572,381 | 2/1926 | Cowles | 123/187.5 R |
| 3,620,202 | 11/1971 | Ross | 123/179 G |
| 3,800,770 | 4/1974 | Baribeau | 123/459 |
| 3,805,758 | 4/1974 | May | 123/187.5 R |
| 3,948,589 | 4/1976 | DuBois | 123/187.5 R |
| 3,978,839 | 9/1976 | DuBois | 123/187.5 R |
| 3,983,857 | 10/1976 | O'Connor | 123/187.5 R |
| 3,987,775 | 10/1976 | O'Connor | 123/187.5 R |
| 4,194,483 | 3/1980 | McChesney | 123/187.5 R |
| 4,204,511 | 5/1980 | Morris | 123/187.5 R |

FOREIGN PATENT DOCUMENTS

| | | | |
|---|---|---|---|
| 666124 | 7/1963 | Canada | 123/514 |

*Primary Examiner*—Charles J. Myhre
*Assistant Examiner*—Carl Stuart Miller
*Attorney, Agent, or Firm*—Michael, Best & Friedrich

[57] ABSTRACT

An engine comprises a combustion chamber and a fuel transfer passage having a fuel outlet port communicating with the combustion chamber. A primary fuel delivery system communicates with the combustion chamber and introduces fuel from the fuel source into the combustion chamber. The engine further comprises a fuel pump which is adapted to be connected with a source of fuel and a fuel return line having a first end communicating with the source. A mechanism selectively controls the communication of the fuel pump with either the fuel return line or the fuel transfer passage, so that an enriched flow of fuel can be selectively supplied to the combustion chamber prior to and after starting.

11 Claims, 4 Drawing Figures

FUEL PRIMER AND ENRICHMENT SYSTEM FOR AN INTERNAL COMBUSTION ENGINE

FIELD OF THE INVENTION

The invention generally relates to internal combustion engines and, more particularly, to fuel priming and enrichment systems for use with internal combustion engines.

DESCRIPTION OF THE PRIOR ART

Attention is directed to the following U.S. patents which generally disclose fuel priming and enrichment systems for internal combustion engines:

Cowles—U.S. Pat. No. 1,572,381—Feb. 9, 1926
Ross—U.S. Pat. No. 3,620,202—Nov. 16, 1971
May—U.S. Pat. No. 3,805,758—Apr. 23, 1974
O'Connor—U.S. Pat. No. 3,983,857—Oct. 5, 1976
O'Connor—U.S. Pat. No. 3,987,775—Oct. 26, 1976

Attention is also directed to U.S. Pat. No. 4,309,968 [filed July 25, 1979] entitled "FUEL PRIMER AND ENRICHMENT SYSTEM FOR INTERNAL COMBUSTION ENGINE" and to the citation of prior art therein. This pending application is assigned to the assignee of the present invention.

SUMMARY OF THE INVENTION

The invention provides an engine comprising a combustion chamber and wall means for defining a fuel transfer passage having a fuel outlet port communicating with the combustion chamber. Primary fuel delivery means communicates with the combustion chamber and is adapted for connection to a fuel source. The primary fuel delivery means is operative for introducing fuel from the fuel source into the combustion chamber. The engine further comprises a fuel pump which is adapted to be connected with a source of fuel and a fuel return line having a first end communicating with the source. Means is provided for selectively controlling the communication of the fuel pump with the fuel return line and the fuel transfer passage.

In one embodiment of the invention, the control means includes means operative independently of the fuel pump for pumping fuel into the fuel transfer passage.

In one embodiment of the invention, the fuel return line has a second end spaced from its first end. In this embodiment, the control means includes a fuel supply line which includes an inlet end portion communicating with the fuel pump, an outlet end portion communicating with the fuel transfer passage, and a midportion communicating with the second end of the fuel return line. The control means further includes valve means movable in the fuel supply line for selectively controlling the communication between the inlet and outlet end portions thereof as well as communication between the inlet end portion of the fuel supply line and the second end of the fuel return line. In this embodiment, the valve means includes means operative independently of the fuel pump for pumping fuel from the inlet end portion of the fuel supply line through the outlet end portion thereof in response to sequential movement of the valve means in the fuel supply line.

In one embodiment of the invention, the valve means includes plunger means operatively movable in the fuel supply line between a first position blocking the communication between the inlet and outlet end portions of the fuel supply line while affording communication between the inlet end portion of the fuel supply line and the second end of the fuel return line, and second and third positions progressively spaced from the first position. Each of the second and third positions blocks the communication between the inlet end portion of the fuel supply line and the second end of the fuel return line while affording communication between the inlet and outlet end portions of the fuel supply line. In this embodiment, the pumping means is operatively connected with the plunger means for pumping fuel from the inlet end portion of the fuel supply line through the outlet end portion thereof in response to movement of the plunger means between its second position and its third position.

In one embodiment of the invention, the control means includes spring means for returning the plunger means from its third position toward its second position.

In one embodiment of the invention, the fuel pump includes a source of pulsating pressure and a diaphragm operatively connected with the source of pulsating pressure for pumping fuel in response thereto. In this embodiment, the primary fuel delivery means includes a carburetor having a fuel chamber communicating with the fuel source, and the fuel pump and the first end of the fuel return line each communicate with the fuel chamber of the carburetor.

One of the principal features of the invention is the provision of an engine having a primary fuel delivery system and a secondary fuel delivery system which is operative for selectively enriching the quantity of fuel delivered by the primary fuel delivery system during normal engine operations as well as for priming the engine prior to and during cranking operations.

Another one of the principal features of the invention is the provision of an engine having a secondary fuel delivery system which includes a control mechanism which is movable between first and second operational positions to control the flow of fuel through the secondary fuel delivery system subject to the operation of an associated fuel pump as well as sequentially movable between the second operational position and a third operational position for manually pumping fuel through the secondary fuel delivery system independently of operation of the fuel pump.

Other features and advantages of the embodiments of the invention will become known by reference to the following general description, claims, and drawings.

Figure 1:
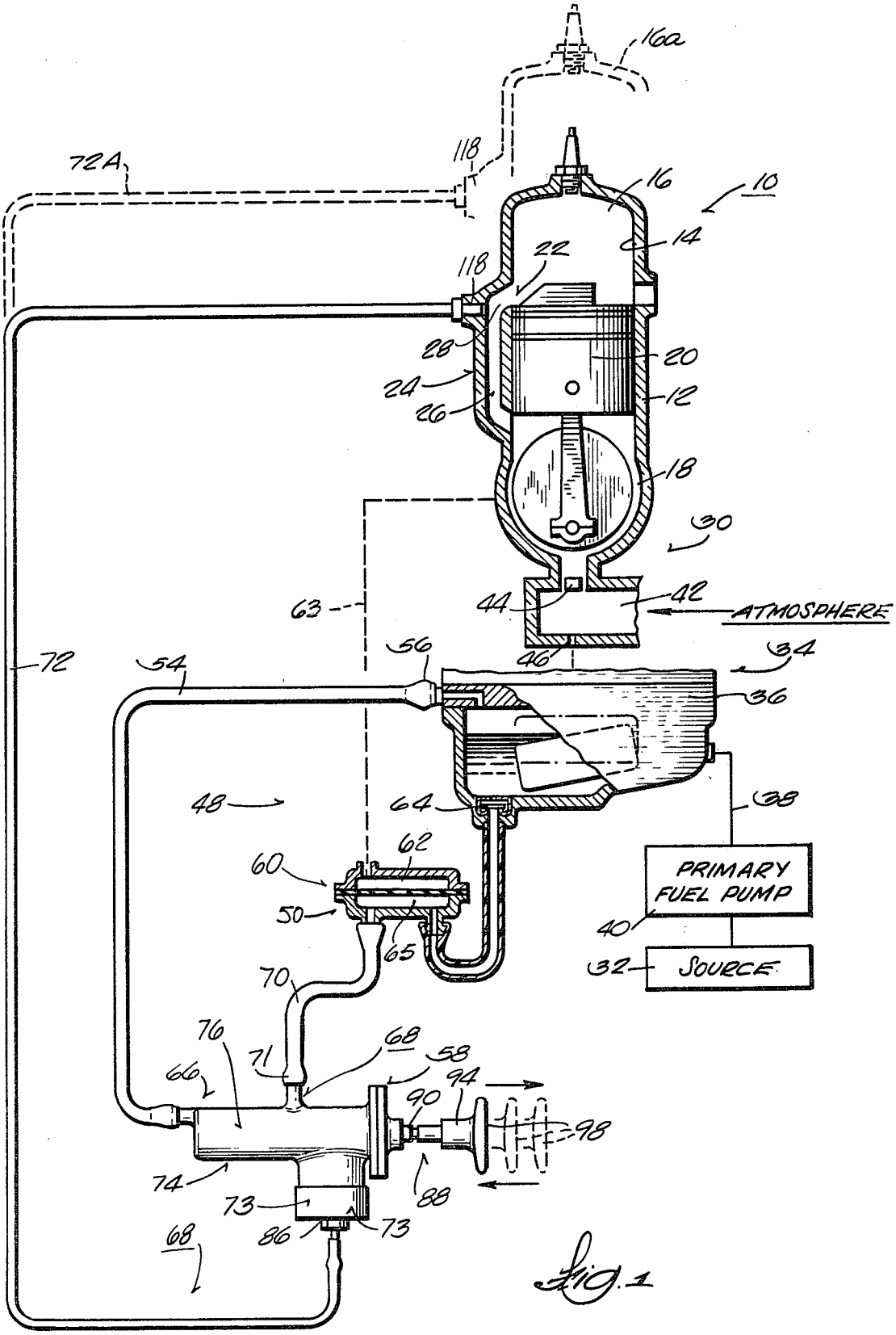
FIG. 1 is a diagrammatic view of an internal combustion engine having a fuel priming and enrichment system which embodies various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

GENERAL DESCRIPTION

Shown in FIG. 1 is an internal combustion engine 10 which embodies various of the features of the invention. While various engine constructions are possible, in the illustrated embodiment (see FIG. 1), a block member 12 includes a cylinder 14 which defines a combustion chamber 16. The block member 12 also includes a crankcase 18 which extends from the cylinder 14. A piston 20 is mounted by conventional means for reciprocative movement inside the cylinder 14.

Still referring principally to FIG. 1, the engine 10 further includes wall means 22 within the cylinder 14 for defining a fuel transfer passage 24 having an inlet port 26 communicating with the crankcase 18 and an outlet port 28 communicating with the combustion chamber 16.

The engine 10 also includes primary fuel delivery means 30 which communicates with the combustion chamber 16 and which is adapted for connection to a fuel source 32. The primary fuel delivery means 30 is operative for introducing fuel from the fuel source 32 into the combustion chamber 16. While the primary fuel delivery means 30 may be variously constructed, in the illustrated embodiment, a carburetor 34 having a fuel chamber 36 is provided. A fuel conduit 38 communicates with a source of fuel 32 and the fuel chamber 36 for carrying fuel into the fuel chamber 36. A mechanical or pulse-activated primary fuel pump 40 or the like is connected in line with the fuel conduit 38 for pumping fuel into the fuel chamber 36.

The carburetor 34 also includes an air induction passage 42 which directs air from the atmosphere into the crankcase 18, typically through a conventinal reed valve assembly 44. As air flows through the air induction passage 42 toward the crankcase 18, fuel is drawn from the fuel chamber 36 into the air induction passage 42 through a suitable fuel metering orifice 46. The air-fuel mixture is thereafter drawn into the crankcase 18 through the reed valve assembly 44 and thence into the combustion chamber 16 through the fuel transfer passage 24 in response to pulsating pressure variations which occur in the crankcase 18 during piston reciprocation.

To selectively provide for an enriched flow of fuel to the combustion chamber 16 during periods prior to and after starting, the engine 10 includes second fuel delivery system 48 for selectively introducing fuel into the combustion chamber 16 in addition to the fuel which is introduced by the primary fuel delivery means 30. While the second fuel delivery system 48 may be variously constructed, in the illustrated embodiment, the system 48 includes a fuel pump 50 which is adapted to be connected with the source of fuel 32 and a fuel return line 54 having a first end 56 communicating with the source 32. Means 58 is provided for selectively controlling the communication of the fuel pump 50 with either the fuel return line 54 or the fuel transfer passage 24.

While the fuel pump 50 may be variously constructed, in the illustrated embodiment (see FIG. 1), it takes the form of a pulse-activated pump having a diaphragm 60 mounted in a chamber 62 which communicates with the crankcase 18, as is generally shown by the dotted line connection 63 in FIG. 1. Pulsating pressure variations occurring in the crankcase 18 in response to piston reciprocation move or flex the diaphragm 60 to pump fuel through the associated chamber 65.

As can also be seen in FIG. 1, in the illustrated embodiment, the fuel pump 50 communicates directly with the fuel chamber 36 of the carburetor 34, as does the first end 56 of the fuel return line 54. A check valve 64 is placed in line between the fuel pump 50 and the fuel chamber 36 to prevent the backflow of fuel from the pump 50 into the fuel chamber 36.

In the illustrated embodiment (as best shown in FIG. 1), the fuel return line 54 has a second end 66 spaced from its first end 56. The control means 58 includes a fuel supply line 68 which is divided into an inlet end portion 70 which communicates with the pulse chamber 65 of the fuel pump 50 downstream of the fuel pump 50, an outlet end portion 72 which communicates with the fuel transfer passage 24, and a midportion 74 which communicates with the second end 66 of the fuel return line 54.

The control means 58 further includes valve means 76 movable in the fuel supply line 68 (as generally indicated by arrows in FIG. 1 and is shown sequentially in FIGS. 2 and 3) for selectively controlling the communication between the inlet and outlet end portions 70 and 72 of the fuel supply line 68 as well as the communication between the inlet end portion 70 of the fuel supply line 68 and the second end 66 of the fuel return line 54. By virtue of this construction, and as will be described in greater detail later herein, fuel flow in response to operation of the fuel pump 50 can be selectively routed by operation of the valve means 76 into either the fuel transfer passage 24, thus serving to enrich the supply of combustible fuel introduced into the combustion chamber 16 by the primary fuel delivery means 34, or back to the fuel chamber 36 through the fuel return line 54 when the enriched flow of fuel is not desired.

In the illustrated embodiment, the valve means 76 further includes means 78 (see FIGS. 2 through 4) operative for pumping fuel through the fuel supply line 68 and into the fuel transfer passage 24 in response to sequential movement of the valve means 76 in the fuel supply line 68, regardless of whether the fuel pump 50 is operating. By virtue of this construction, the valve means 76 and associated pumping means 78 can serve to introduce fuel into the combustion chamber 16 to prime the engine 10 prior to starting.

Referring now to the particular construction of the fuel supply line 68 and associated valve and pumping means 76 and 78, in the illustrated embodiment (see FIGS. 2 through 4), the midportion 74 of the fuel supply line 68 takes the shape of a generally cylindrical supply passage 80 having oppositely spaced first and second ends 82 and 84. The inlet end portion 70 of the fuel supply line includes an end 71 which communicates with the supply passage 80 generally intermediate its first and second ends 82 and 84. The second end 66 of the fuel return line 54 communicates with the supply passage 80 between the end 71 of the inlet end portion 70 and the first end 82 of the supply passage 80. Similarly, the outlet end portion 72 of the fuel supply line 68 includes an end 73 which communicates with the supply passage 80 between the end 71 of the inlet end portion 70 and the second end 84 of the supply passage 80. A check valve 86 is placed in line with the outlet end portion 72 to prevent the backflow of fuel from the outlet end portion 72 of the supply line 68 into the supply passage 80.

Figure 2:
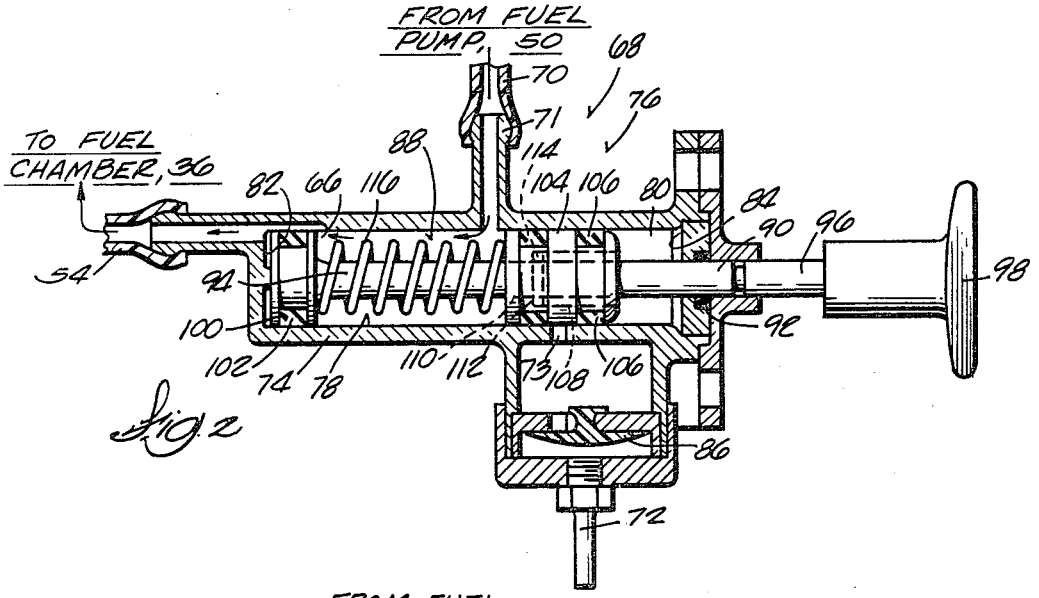
FIG. 2 is a sectional view of a control mechanism which is incorporated in the fuel priming and enrichment system shown in FIG. 1 and which is shown in an "off" position.
Figure 3:
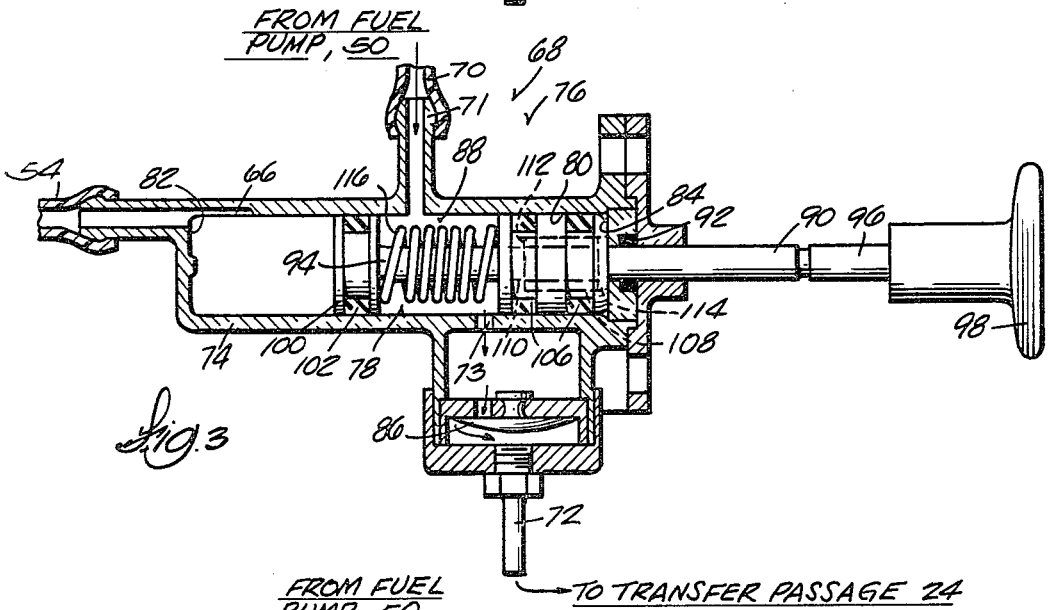
FIG. 3 is a sectional view of the control mechanism shown in FIG. 2 except that the mechanism is shown in a "prime" position.
Figure 4:
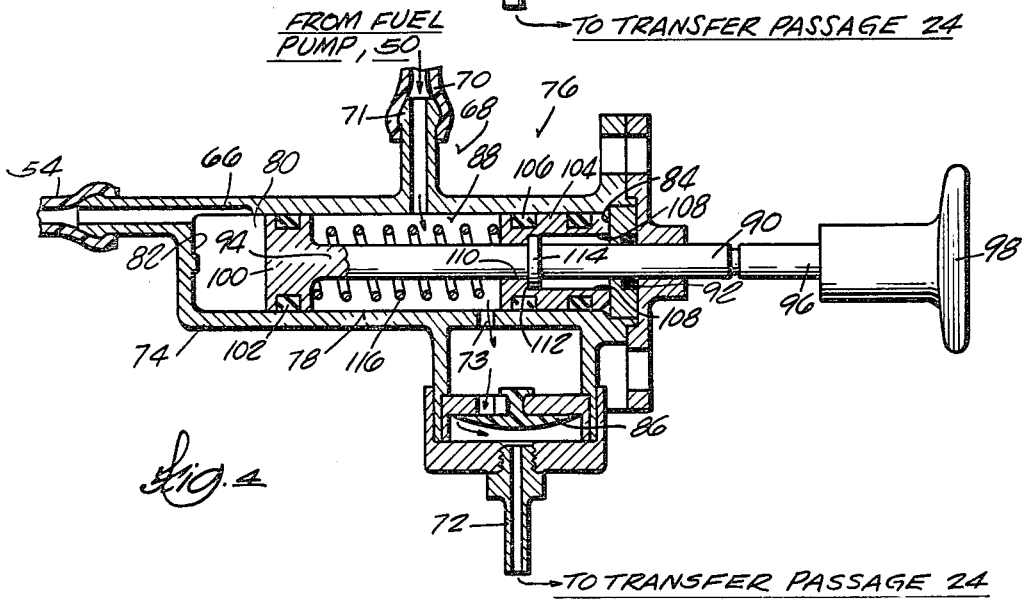
FIG. 4 is a sectional view of the control mechanism shown in FIG. 2 except that the mechanism is shown in a "on" position.

In the illustrated construction, the valve means 76 includes a plunger mechanism 88 movable between the first and second ends 82 and 84 of supply passage 80. As can be seen in FIGS. 2 through 4, the plunger mechanism 88 includes a control rod 90 which is movably mounted in a gasket-lined aperture 92 formed in the second end 84 of the supply passage 80. The control rod 90 is thus divided into an end portion 94 which is confined within the supply passage 80 and an end portion 96 which extends outwardly beyond the second end 84 of the supply passage 80 and to which a handle 98 is attached.

A plunger piston 100 having a diameter which closely fits the internal diameter of the supply passage 80 is attached to the confined end portion 94 of the control rod 90. The plunger piston 100 includes an o-ring 102 or other suitable resiliant gasket to affect a sealing engagement between the plunger piston 100 and the interior sidewall of the supply passage 80. This sealing engagement blocks the passage of the fuel through the supply passage 80 at the point where the o-ring 102 is situated, while permitting the positioning of the plunger piston 100 in the supply passage 80 in response to control rod movement.

The plunger mechanism 88 also includes a collar member 104 carried by the confined end portion 94 of the control rod 90 between the plunger piston 100 and the second end 84 of the supply passage 80. Like the heretofore described plunger piston 100, the collar member 104 closely fits the internal diameter of the supply passage 80 and includes one or more o-rings 106 or other suitable resilient gasket to affect a sealing engagement between the collar member 104 and the interior sidewall of the supply passage 80. This sealing engagement blocks the passage of fuel through the supply passage 80 at the point where the o-rings 106 are situated, while permitting the positioning of the collar member 104 in the supply passage 80 in response to control rod movement.

More particularly, and as can best be seen in FIG. 4, the collar member 104 includes axially aligned first and second longitudinal bores 108 and 110. The second bore 110 has an interior diameter which is less than the interior diameter of the first bore 108. An annular shoulder 112 is thus formed within the collar member 104 at the junction of the two bores 108 and 110.

The control rod 90 includes an annular member 114 having an external diameter less than the diameter of the first bore 108 and greater than the diameter of the second bore 110. The annular member 114 is thus movable within the first bore 108 but not within the second bore 110.

A spring 116 is carried by the control rod 90 and biases the collar member 104 away from the piston plunger 100 such that the annular member 114 is normally maintained against the annular shoulder 112 within the collar member 104 (see FIGS. 2 and 4).

By virtue of this construction movement of the control rod 90 serves to jointly position the plunger piston 100 and the collar member 104 at three successively spaced operative positions within the supply passage 80.

Referring first to FIG. 2, when the plunger piston 100 is generally seated against the first end 82 of the supply passage 80, communication is afforded between the inlet end portion 70 of the supply line 68 and the fuel return line 54. When the plunger piston 100 is so positioned, the collar member 104 is located so as to block communication between the inlet end portion 70 and outlet end portion 72 of the fuel supply line 68.

By virtue of this positioning, the flow of fuel in response to operation of the fuel pump 50 (as is generally shown by arrows in FIG. 2) is routed from the fuel chamber 36 of the carburetor 34 into the supply passage 80 through the inlet end portion 70 of the fuel supply line 68, and thence returned directly to the fuel chamber 36 of the carburetor 34 through the fuel return line 54. Flow of fuel into the fuel transfer passage 24, and thus into the combustion chamber 16 itself, is blocked by the collar member 104. This position of the control rod 90 will hereafter be referred to as the "off" position. When the control rod 90 is in its "off" position, all fuel introduced into the combustion chamber 16 is supplied by the primary fuel delivery means 30, as is usually desirable during normal warm engine operations.

Referring now to the second position of the control rod 90 (as shown in FIG. 4), movement of the control rod 90 outwardly beyond the just described "off" position eventually moves the collar member 104 into abutment against the second end 84 of the supply passage 80. When so positioned, communication is afforded between the inlet and outlet end portions 70 and 72 of the fuel supply line 68. Conversely, the piston plunger 100 is now positioned between the inlet end portion 70 of the fuel supply line 68 and the fuel return line 54, blocking communication therebetween.

When the piston plunger 100 and collar member 104 are so positioned, the flow of fuel in response to operation of the fuel pump 50 (as is generally shown in arrows in FIG. 4) is routed from the fuel chamber 36 of the carburetor 34, into the supply passage 80 through the inlet end portion 70 of the fuel supply line 68, and thence into the fuel transfer passage 24, and thus into the combustion chamber 16, through the outlet end portion 72 of the fuel supply line 68. The flow of fuel through the fuel return line is blocked by the piston plunger 100. This position of the control rod 90 will hereafter be referred to as the "on" position. When the control rod 90 is in the "on" position and the fuel pump 50 is operating, fuel delivered to the combustion chamber 16 by the primary fuel delivery means 30 is supplemented or enriched by the flow of fuel through the fuel supply line 68. Such an enriched flow of fuel is usually desired during periods of engine warm-up after starting to enhance engine performance and minimize stalling.

Referring now to the third position of the control rod 90 (see FIG. 3), movement of the control rod 90 outwardly beyond the just described "on" position moves the annular member 114 of the control rod 90 within the first bore 108 of the now stationary collar member 104. Eventually, the annular member 114 will come into abutment against the second end 84 of the supply passage 80.

Meanwhile, the plunger piston 100 advances against the biasing force of the spring 116 toward the now stationary collar member 104, expelling fuel confined between the plunger piston 100 and the collar member 104 from the supply passage 80 and into the outlet end portion 72 of the fuel supply line 68. This third position of the control rod 90 will hereafter be referred to as the "prime" position, inasmuch as movement of the control rod 90 from its "on" position (FIG. 4) to its "prime"

position (FIG. 3) injects a quantity of fuel into the combustion chamber 16 through the fuel transfer passage 24, regardless of whether or not the fuel pump 50 is operating. It is thus possible to selectively prime the engine 10 before and during engine cranking operations to facilitate starting.

When the control rod 90 is subsequently released from its "prime" position (FIG. 3), the compressed spring 116 moves the plunger piston 100 away from the still stationary collar member 104. The annular member 114 of the control rod 90 travels within the first bore 108 until abutment against the annular shoulder 112 in the collar member 104 is made. At this point, the relative positions of the two members 100 and 104 is as shown in FIG. 4, and the control rod 90 is back in its "on" position. Subsequent manual movement of the control rod 90 inwardly of the "on" position returns the control rod back to its "off" position (FIG. 2).

In the illustrated embodiment, the outlet end portion 72 of the supply line 68 includes a nozzle 118 which communicates with the fuel transfer passage 24 adjacent to its outlet port 28. By virtue of this construction, fuel carried by the fuel supply line 68 to the nozzle 118 is emitted directly into the combustion chamber 16 through the fuel outlet port 28.

The invention is applicable for use with engines having more than one combustion chamber. In this construction, and as is shown in phantom lines in FIG. 1, the outlet end portion 72 of the fuel supply line 68 includes a branch portion 72A which communicates with an associated second combustion chamber 16A. Operation of the heretofore described control means 58 serves to simultaneously control the flow of fuel through the supply line 68 into both combustion chambers 16 and 16A.

The heretofore described second fuel delivery system 48 serves both as a fuel primer to improve initial engine starting as well as a fuel enrichment system to reduce stalling tendencies and to reduce crankcase flooding during subsequent engine warm-up.

Various of the features of the invention are set forth in the following claims.

We claim:

1. An engine comprising a combustion chamber having a fuel port, a primary fuel delivery means adapted for connection to a source of fuel and communicating with said combustion chamber for introducing fuel from the fuel source into said combustion chamber, and a secondary fuel delivery means including a fuel pump adapted to be connected to a source of fuel, a fuel return line adapted for communication with the source of fuel, and means for selectively communicating said fuel pump with said fuel return line and with said fuel port independently of said primary fuel delivery means, said means for selectively communicating said fuel pump with said fuel return line and with said fuel port including means operative independently of said fuel pump for pumping fuel to said fuel port.

2. An engine according to claim 1 wherein said engine includes wall means defining a transfer passage communicating through said fuel port with said combustion chamber and communicating with said primary fuel delivery means, and wherein said control means includes nozzle means extending into said fuel transfer passage adjacent to said fuel port for emitting fuel directly into said combustion chamber through said fuel port.

3. An engine according to claim 1 wherein said fuel pump includes a diaphragm operatively connected with a source of pulsating pressure for pumping fuel in response thereto.

4. An engine according to claim 1 wherein said primary fuel delivery means includes a carburetor having a fuel chamber which constitutes a source of fuel, and wherein said fuel pump and fuel return line each communicates with said fuel chamber.

5. An engine comprising a combustion chamber having a fuel port, primary fuel delivery means adapted for connection to a source of fuel and communicating with said combustion chamber for introducing fuel from the fuel source into said combustion chamber, and a secondary fuel delivery means including a fuel pump adapted to be connected to a source of fuel, a fuel return line adapted for communication with the source of fuel, and means for selectively communicating said fuel pump with said fuel return line and with said fuel port independently of said primary fuel delivery means, said means for selectively communicating said fuel pump with said fuel return line and with said fuel port including a fuel supply line including an inlet end portion communicating with said fuel pump, and an outlet end portion communicating with said fuel pump, and a midportion between said fuel supply line inlet and outlet end portions and communicable with said fuel return line, and valve means movable in said fuel supply line for selectively communicating said inlet and outlet end portions of said fuel supply line and said inlet end portion of said fuel supply line and said fuel return line.

6. An engine comprising a combustion chamber, wall means for defining a fuel transfer passage having a fuel outlet port communicating with said combustion chamber, primary fuel delivery means adapted for connection to a source of fuel and communicating with said combustion chamber for introducing fuel from the fuel source into said combustion chamber, a fuel pump adapted to be connected with a source of fuel, a fuel return line having a first end adapted for communicating with the source, and a second end spaced from said first end, and means for selectively controlling the communication of said fuel pump with said fuel return line and said fuel transfer passage and comprising a fuel supply line including an inlet end portion communicating with said fuel pump, and outlet end portion communicating with said fuel transfer passage, and a midportion between said fuel supply line inlet and outlet end portions and communicable with said second end of said fuel return line, and valve means movable in said fuel supply line for selectively controlling the communication between said inlet and outlet end portions of said fuel supply line and between said inlet end portion of said fuel supply line and said second end of said fuel return line, said valve means including means operative independently of said fuel pump for pumping fuel from said inlet end portion of said fuel supply line through said outlet end portion thereof and into said fuel transfer passage in response to sequential movement of said valve means in said fuel supply line.

7. An engine according to claim 6 wherein said valve means includes plunger means operatively movable in said fuel supply line between a first position blocking the communication between said inlet and outlet end portions of said fuel supply line while affording communicating between said inlet end portion of said fuel supply line and said second end of said fuel return line, and second and third positions progressively spaced from said first position, each of said second and third positions blocking communicating between said inlet end portion of said fuel supply line and said second end of said fuel return line while affording communication between said inlet and outlet end portions of said fuel supply line, and wherein said pumping means is operatively connected with said plunger means for pumping fuel from said inlet end portion of said fuel supply line through said outlet end portion thereof in response to movement of said plunger means between said second position and said third position.

8. An engine according to claim 7 wherein said mid-portion of said fuel supply line includes a supply passage having oppositely spaced first and second end portions, wherein said inlet end portion of said fuel supply line includes an end communicating with said supply passage generally intermediate said first and second end portions thereof, wherein said second end of said fuel return line communicates with said supply passage generally intermediate said end of said fuel supply line inlet end portion and said first end portion of said supply passage, wherein said outlet end portion of said fuel supply line includes an end communicating with said supply passage generally intermediate said end of said fuel supply line inlet end portion and said second end portion of said supply passage, and wherein said plunger means is movable in said supply passage between said first and second end portions thereof.

9. An engine according to claim 8 wherein said supply passage includes an interior sidewall, wherein said plunger means includes a piston member sealingly engaging said sidewall of said supply passage and including a piston rod extending from said piston member through said second end portion of said supply passage, a collar member carried by said piston rod generally intermediate said piston member and said second end of said supply passage and sealingly engaging said sidewall of said supply passage, said piston member and said collar member being movable in said supply passage in response to movement of said piston rod between said first position, in which said piston member is located generally intermediate said first end portion of said supply passage and said second end of said fuel return line and said collar member is located generally intermediate said end of said inlet end portion of said fuel supply line and said end of said outlet end portion thereof, and said second position and said third position, in each of which said second and third positions said piston member is located generally intermediate said second end of said fuel return line and said end of said inlet end portion of said fuel supply line and said collar member is located generally intermediate said end of said outlet end portion of said fuel supply line and said second end portion of said supply passage.

10. An engine according to claim 9 wherein said pumping means includes means operative during movement of said piston rod between said second and third positions for preventing movement of said collar member in said supply passage while permitting movement of said piston member in said supply passage toward and away from said stationary collar member.

11. An engine according to claim 7 wherein said control means includes spring means for returning said plunger means from said third position toward said second position.

* * * * *